US008077056B2

(12) United States Patent
Watanabe

(10) Patent No.: US 8,077,056 B2
(45) Date of Patent: Dec. 13, 2011

(54) IMMOBILIZER RECEIVER FOR OUTBOARD MOTOR

(75) Inventor: Eifu Watanabe, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 427 days.

(21) Appl. No.: 12/477,940

(22) Filed: Jun. 4, 2009

(65) Prior Publication Data

US 2009/0303085 A1 Dec. 10, 2009

(30) Foreign Application Priority Data

Jun. 9, 2008 (JP) ..... 2008-151086

(51) Int. Cl.
*G08B 23/00* (2006.01)

(52) U.S. Cl. ..... 340/984; 440/6

(58) Field of Classification Search ..... 340/984; 318/588; 440/1, 6; 701/21
See application file for complete search history.

(56) References Cited

U.S. PATENT DOCUMENTS 6,902,446 B1 * 6/2005 Healey ..... 440/6
7,186,154 B2 * 3/2007 Takashima et al. ..... 440/1
2006/0052914 A1 * 3/2006 Kubokawa et al. ..... 701/21

FOREIGN PATENT DOCUMENTS

JP 2006-175999 A 7/2006

* cited by examiner

*Primary Examiner* — John A Tweel, Jr.
(74) *Attorney, Agent, or Firm* — Keating & Bennett, LLP

(57) ABSTRACT

An immobilizer receiver for an outboard motor includes a control unit that is housed in a liquid-tight case and arranged to receive an authentication code, an antenna wire arranged to receive the authentication code, and an answer-back buzzer arranged to provide an indication that the authentication code has been received, which are housed in a recessed section of a housing. A distance from an opening surface to a bottom surface of the recessed section of the housing is arranged such that the antenna wire can receive the authentication code even in a case that a hull is made of metal. Then, the opening surface of the housing is preferably mounted on a vertical or approximately vertical surface of the hull. Therefore, it is possible to secure a receiving function of the antenna wire that is housed on the bottom surface of the recessed section. In addition, the answer-back buzzer is protected against coming in contact with water. The immobilizer receiver can easily be mounted to a hull and has a receiving function that is secured.

7 Claims, 3 Drawing Sheets

IMMOBILIZER RECEIVER FOR OUTBOARD MOTOR

BACKGROUND OF THE INVENTION

1. Field of the Invention

The present invention relates to an immobilizer receiver for an outboard motor, and more particularly, relates to an immobilizer receiver for an outboard motor that is suitable to be retrofitted to a hull.

2. Description of the Related Art

Many watercrafts are tied up and kept on the ocean, a lake, or a river. Thus, a watercraft with an outboard motor as a propulsion unit may get stolen as long as an engine of the outboard motor can be started. Considering the above issue, immobilizer systems that have been widely used for two-wheeled and four-wheeled vehicles have also been introduced to watercrafts in relation to recent electronic control of the outboard motor including the engine. As it has been widely known, the immobilizer system receives an authentication code from a transmitter called a transponder (repeater) and, for example, permits the activation of the engine only when the code is authorized. Various changes can be made to control settings of the immobilizer system by an electronic control unit for the outboard motor that includes the engine after the authentication of the code, and can also be made between a user and a dealer in outboard motors and watercrafts, for example. A variety of methods to authenticate the authentication code are described in JP-A-2006-175999.

When the receiver of the immobilizer system is mounted to the hull by so-called retrofitting, it is particularly difficult to mount an antenna wire for reception and an answer-back buzzer that informs the authentication of the authentication code. When the hull is made of metal, and the antenna wire is too close to the hull, the antenna wire cannot receive the authentication code. In addition, because of poor resistance to water, the answer-back buzzer may malfunction once it gets wet. Thus, there has been a demand for an immobilizer receiver for an outboard motor that can easily be mounted to a hull and secure a receiving function while avoiding or solving the above problems.

SUMMARY OF THE INVENTION

In view of the problems mentioned above, preferred embodiments of the present invention provide an immobilizer receiver for an outboard motor that can easily be mounted to a hull and secure a receiving function.

An immobilizer receiver for an outboard motor according to a preferred embodiment of the present invention includes a control unit that is housed in a liquid-tight case and is arranged to receive an authentication code; an antenna wire arranged to receive the authentication code; an answer-back buzzer arranged to provide an indication that the authentication code has been received; a housing that is made of an insulating material and houses the control unit, the antenna wire, and the answer-back buzzer in a recessed section. The recessed section of the housing has an opening surface and a bottom surface on the opposite side of the opening surface. The opening surface of the housing is a mounting surface to be mounted to a surface, such as a vertical or approximately vertical surface, of a hull. A distance from the opening surface to the bottom surface is a predetermined distance. The antenna wire is housed in the recessed section and disposed along the bottom surface thereof.

In the immobilizer receiver for an outboard motor, when the opening surface of the housing, which is made of the insulating material, is mounted to the vertical or approximately vertical surface of the hull, the antenna wire, which is housed in the recessed section and disposed along the bottom surface thereof, is separated from the mounting surface of the hull for the predetermined distance. Thus, it is possible to secure a receiving function of the antenna wire. In addition, because the answer-back buzzer with poor water resistance is covered by the housing that is mounted to the hull, it is possible to secure a function of the answer-back buzzer. Therefore, the overall receiving functions of the immobilizer receiver can be secured while the immobilizer receiver can easily be mounted to the hull.

In the immobilizer receiver for an outboard motor according to a preferred embodiment of the present invention, the antenna wire is housed in the recessed section and disposed along a peripheral wall thereof.

In the immobilizer receiver for an outboard motor, the length of the antenna wire can be secured by disposing the antenna wire along the peripheral wall of the recessed section. The receiving function of the antenna wire can also be secured because the antenna wire is less likely to be separated from the bottom surface of the recessed section.

In the immobilizer receiver for an outboard motor according to a preferred embodiment of the present invention, the predetermined distance from the opening surface to the bottom surface of the recessed section of the housing is set in a manner that the antenna wire can receive the authentication code even when the hull is made of metal.

In the immobilizer receiver for an outboard motor, simply by mounting the opening surface of the housing, which is made of the insulating material, to the vertical or approximately vertical surface of the hull, the antenna wire, which is housed in the recessed section and disposed along the bottom surface thereof, is separated from the mounting surface of the hull for a distance with which the antenna wire can receive the authentication code. Therefore, it is possible to secure the receiving function of the antenna wire and also to facilitate mounting of the antenna wire to the hull.

In the immobilizer receiver for an outboard motor according to a preferred embodiment of the present invention, the antenna wire is fixed to the bottom surface of the recessed section of the housing by being pressed by the control unit.

In the immobilizer receiver for an outboard motor, because the antenna wire is fixed to the bottom surface of the recessed section of the housing by being pressed by the control unit, the receiving function of the antenna wire can easily be secured by securing a distance between the antenna wire and the mounting surface of the hull.

In the immobilizer receiver for an outboard motor according to a preferred embodiment of the present invention, the main body of the answer-back buzzer is housed in the recessed section of the housing in a state that the main body is separated from any of the surfaces of the recessed section.

In the immobilizer receiver for an outboard motor, the main body of the answer-back buzzer is separated from any of the surfaces of the recessed section. Accordingly, even when water enters the recessed section of the housing, water flows down the surfaces of the recessed section and thus does not contact the answer-back buzzer with poor water resistance water. Therefore, it is possible to secure the function of the answer-back buzzer.

In the immobilizer receiver for an outboard motor according to a preferred embodiment of the present invention, an upward direction upon mounting of the immobilizer receiver is indicated on the outside of the recessed section of the housing, and a water drain hole is formed in a portion of the recessed section that faces down upon when mounted to the hull.

In the immobilizer receiver for an outboard motor, the mounting direction of the housing to the hull is secured. Accordingly, even when water enters the recessed section of the housing, water is drained from the water drain hole that is provided in the portion that faces down when mounted to the hull. Therefore, it is possible to secure functions of components with poor water resistance such as the answer-back buzzer.

In the immobilizer receiver for an outboard motor according to a preferred embodiment of the present invention, the water drain hole is located at a position spaced away from a position below the answer-back buzzer in the recessed section when mounted to the hull.

In the immobilizer receiver for an outboard motor, the water drain hole is located at a position that is spaced away from the lower position of the answer-back buzzer. Therefore, even when water enters from the water drain hole, it is possible to avoid direct contact of water with the answer-back buzzer.

According to the immobilizer receiver for an outboard motor according to a preferred embodiment of the present invention, a control unit that is housed in a liquid-tight case and is arranged to receive an authentication code, an antenna wire arranged to receive the authentication code, and an answer-back buzzer arranged to provide an indication that the authentication code was received are housed in a recessed section of a housing that is made of an insulating material. An opening surface of the housing is a mounting surface to be mounted to a surface, such as a vertical or approximately vertical surface, of a hull, and a distance from the opening to a bottom surface of the recessed section of the housing is set as a predetermined distance. Then, the antenna wire is housed in the recessed section and disposed along the bottom surface thereof. Thus, a receiving function of the answer-back buzzer with low resistance to water can be secured by simply mounting the opening surface of the housing to the vertical or approximately vertical surface of the hull. Consequently, it is possible to secure the overall receiving functions of the immobilizer receiver and to facilitate mounting of the immobilizer receiver to the hull.

Other features, elements, arrangements, steps, characteristics and advantages of the present invention will become more apparent from the following detailed description of preferred embodiments of the present invention with reference to the attached drawings.

DETAILED DESCRIPTION OF THE PREFERRED EMBODIMENTS

The following description will be made of preferred embodiments of an immobilizer receiver for an outboard motor in the present invention with reference to the drawings.

Figure 1:
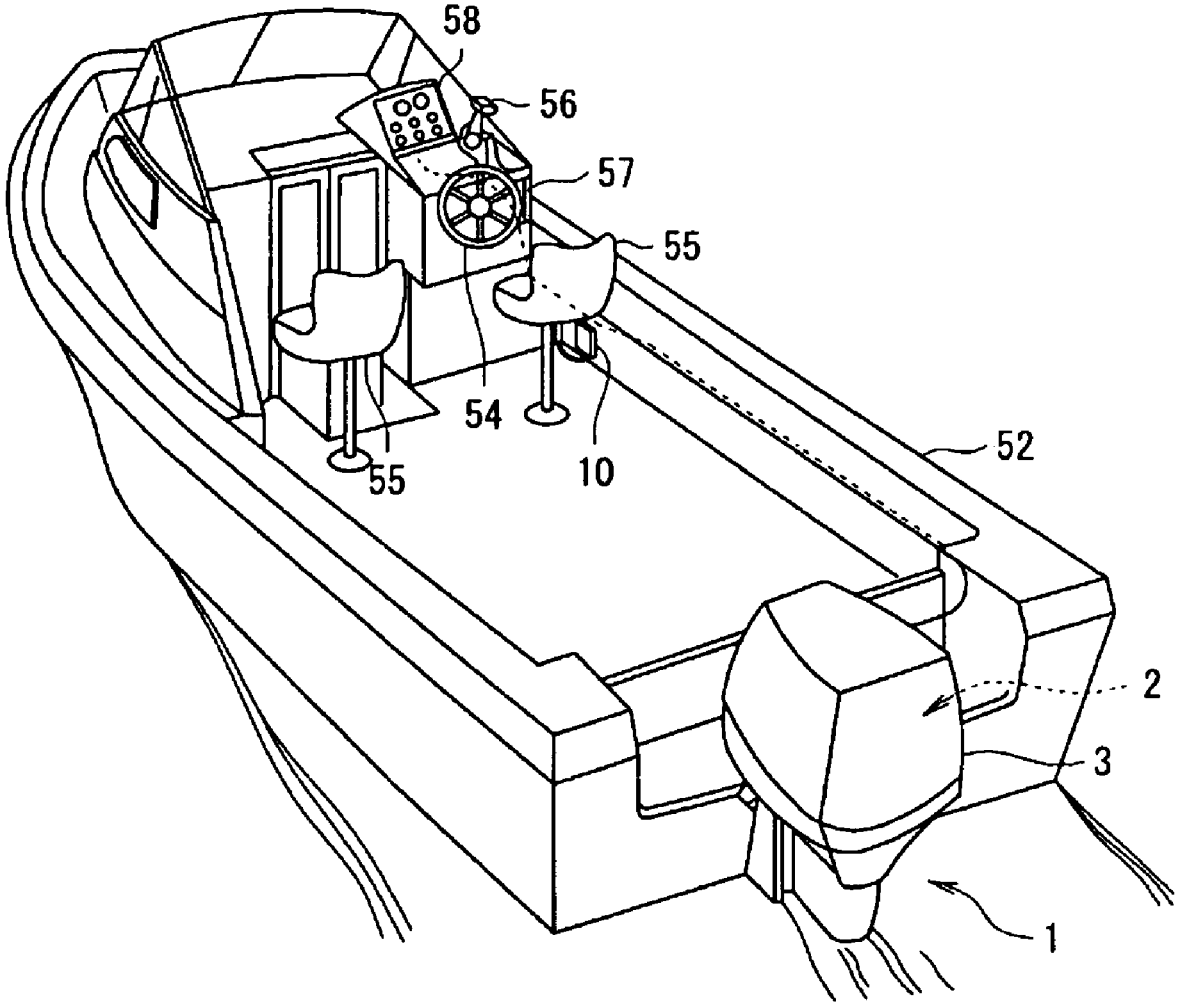
FIG. 1 is a schematic view that shows a configuration of a watercraft to which an immobilizer receiver for an outboard motor according to a preferred embodiment of the present invention is mounted.

FIG. 1 is a schematic view that shows configuration of a small boat to which an immobilizer receiver for an outboard motor in this preferred embodiment is mounted. The small boat has an outboard motor 1 that is mounted on its stern of an open-deck hull 52 and, at its front portion, includes a control compartment in which a steering wheel 54, seats 55, a remote control lever 56, a switch panel 57 that includes a main switch and a starter switch, an instrument panel 58, and the like are arranged. An immobilizer receiver 10 for an outboard motor in this preferred embodiment is preferably mounted on a vertical or approximately vertical surface that is a sidewall of the hull 52. A cable, which will be described later, is connected to the switch panel 57. A mounting position of the immobilizer receiver is not limited to the above and may be any one of vertical or approximately vertical walls of the hull 52 such as a vertical wall of a control console and an inner vertical wall of a box-shaped seat.

Figure 2:
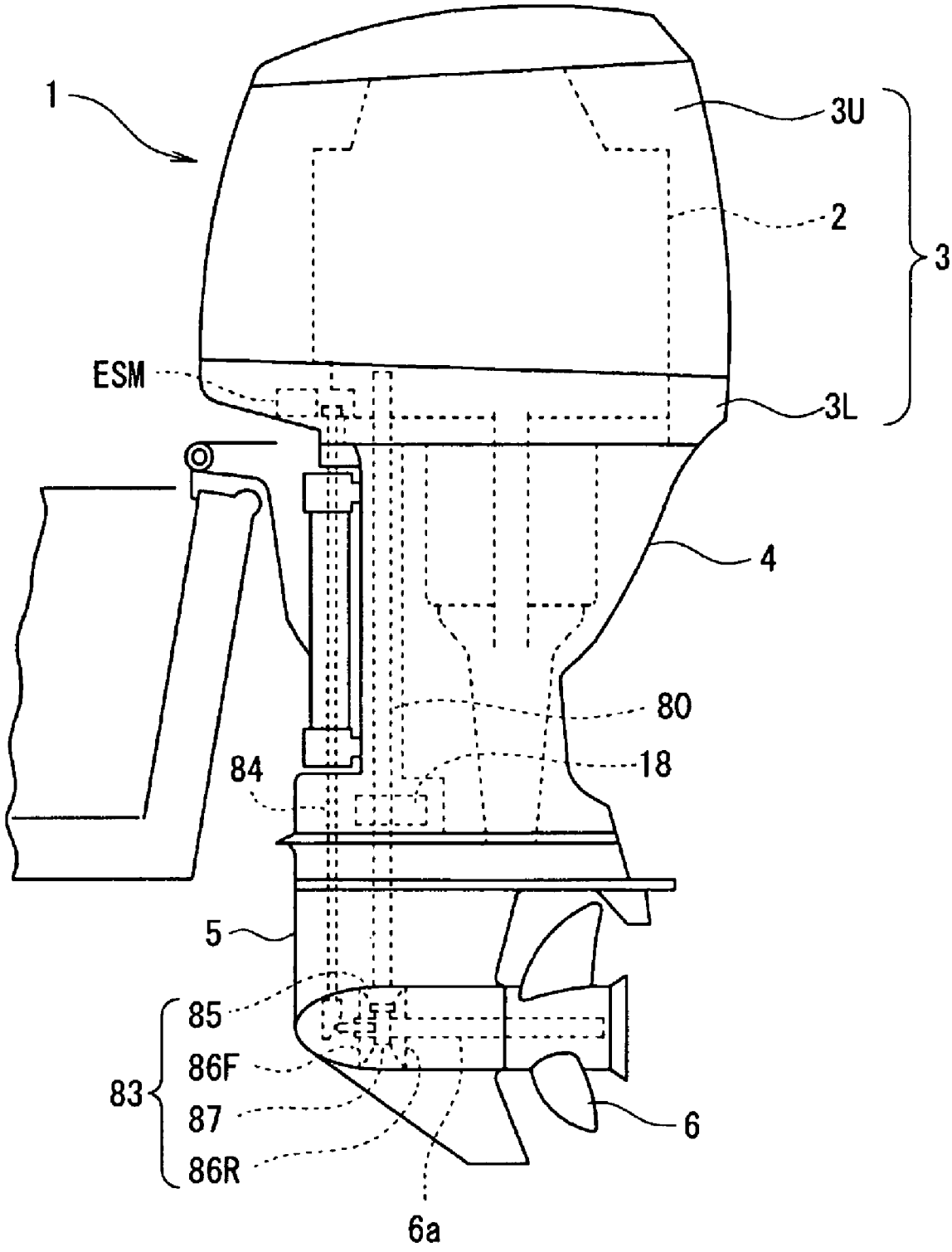
FIG. 2 is an outline drawing of an outboard motor used for the watercraft in FIG. 1.

As shown in FIG. 2, the outboard motor 1 preferably includes a cowl 3, an upper case 4, and a lower case 5 in sequence. The outboard motor 1 is mounted to the hull 52 by a clamp (not shown) for vertical and transverse pivoting movement relative to the hull 52. The cowl 3 is constituted by an upper cowl 3U and a lower cowl 3L and includes therein an engine 2.

A propeller shaft 6*a* as a rotary shaft of a propeller 6 is inserted in the lower case 5. A drive shaft 80 that extends from the inside of the cowl 3 to the inside of the lower case 5 is connected to the propeller shaft 6*a* at its lower end via a shift change mechanism 83 that preferably includes a drive gear 85 including bevel gears, a forward gear 86F, a reverse gear 86R, and a dog clutch 87. Then, a shift rod 84 that is vertically disposed in parallel or substantially in parallel with the drive shaft 80 is rotated by an electrical rotary mechanism ESM that includes an electric motor controlled by an electrical controlled unit (not shown). Consequently, the shift change mechanism 83 is actuated to make a shift change to neutral, forward, or reverse, accordingly, and the rotary force of the drive shaft 80 is subsequently transmitted to the propeller shaft 6*a*.

In other words, in the shift change mechanism 83, a forward gear 86F and a reverse gear 86R, both of which are rotatably disposed on the propeller shaft 6*a*, are engaged with the drive gear 85 that is fixed to the lower end of the drive shaft 80. The dog clutch 87, which is disposed on the propeller shaft 6*a* to be slidable but not rotatable relative thereto, is disposed between the forward gear 86F and the reverse gear 86R. In addition, the dog clutch 87 is slid on the propeller shaft 6*a* in conjunction with the rotation of the shift rod 84 (the rotation of a cam surface at the lower end of the shift rod).

In the shift change mechanism 83 as described above, the shift rod 84 is rotated about its axis by the electrical rotary mechanism, thereby moving the dog clutch 87 either for engagement with one of the forward gear 86F and the reverse gear 86R to transmit the rotation of the drive shaft 80 to the propeller shaft 6*a* via the respective gear, or to an intermediate position between the forward gear 86F and the reverse gear 86R to prevent engagement with any of the gears so that the outboard motor 1 is brought into a neutral state where the rotation of the drive shaft 80 is not transmitted to the drive shaft 6*a*.

A battery on the hull 52 is connected to the outboard motor 1 via a battery switch (not shown) and a battery cable (not shown), and power from the battery is supplied to electrical components of the outboard motor 1. In addition, the outboard motor 1 is connected to the hull 52 by a remote control cable and a throttle shift cable. In this preferred embodiment, the electronic control unit (ECU) for the outboard motor 1 is installed in the outboard motor 1 and connected to the switch panel 57 by the remote control cable. As described above, the switch panel 57 is connected to the immobilizer receiver 10. Therefore, various changes can be made in the control settings by transmitting the authentication result of the authentication code by the immobilizer receiver 10 to the ECU for the outboard motor. In this preferred embodiment, the activation of the engine 2 in the outboard motor 1 is permitted when the authentication code is authenticated by the immobilizer receiver 10. In addition, the engine 2 is activated only when the switch panel 57 outputs an engine activation command after the authentication of the code. The specification after the authentication of the code is not limited to the above, and may include use of the battery switch or cancellation of a shift lock of the shift change mechanism.

Figure 3A:
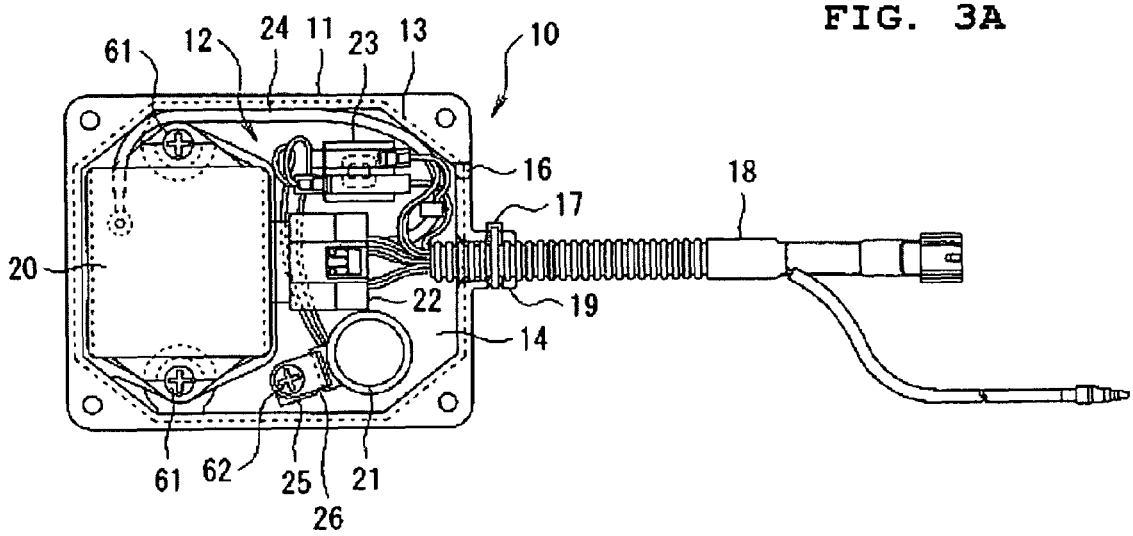
FIGS. 3A-3E are detailed views of the immobilizer receiver for an outboard motor that is mounted to the watercraft in FIG. 1.
Figure 3B:
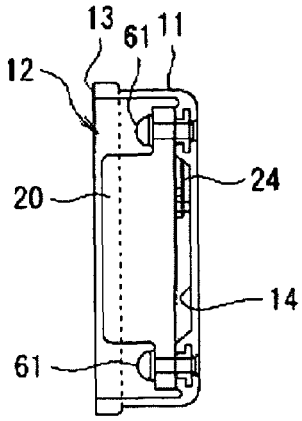
Figure 3C:
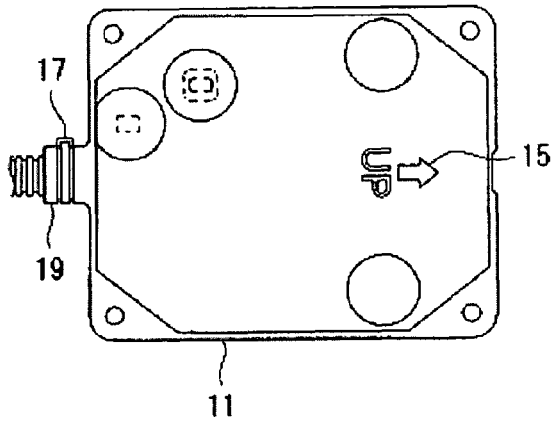
Figure 3D:
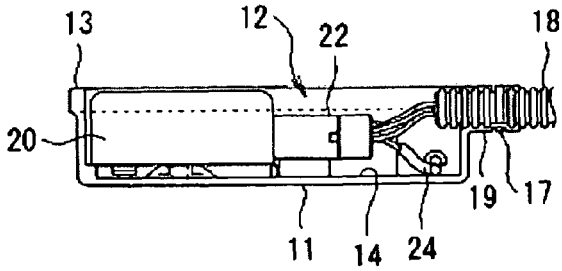
Figure 3E:
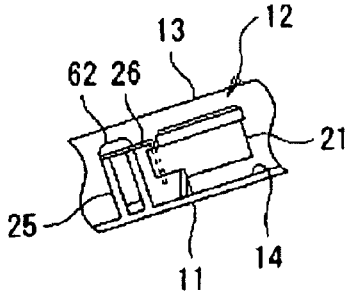

FIGS. 3A-3E show specific configurations of the immobilizer receiver 10 for an outboard motor in this preferred embodiment. FIG. 3A is a front view of the immobilizer receiver 10 in this preferred embodiment, FIG. 3B is a vertical sectional view that shows a mounting state of the control unit, FIG. 3C is a rear view of the immobilizer receiver 10, FIG. 3D is a transverse sectional view that shows the mounting state of the control unit, and FIG. 3E is a sectional view that shows a mounting state of an answer-back buzzer.

The numeral 11 in FIGS. 3A-3E denotes a square-shaped housing with a bottom. The housing 11 is preferably made of an insulating material such as synthetic resin, for example. A concavity of the housing 11 is a recessed section 12, and the recessed section 12 includes an opening surface 13 and a bottom surface 14. The opening surface 13 is a mounting surface to a vertical or approximately vertical surface of the hull 52. A distance from the opening surface 13 to the bottom surface 14 is, for example, preferably set to be at least approximately 30 mm. The above predetermined distance from the opening surface 13 to the bottom surface 14 is preferably set in a manner that, even when the hull 52 is made of metal, an antenna wire, which will be described later and is housed in the recessed section 12 and disposed along the bottom surface 14 thereof, can receive the authentication code after the opening surface 13 is mounted on the mounting surface of the hull 52.

As shown in FIG. 3C, the word "UP" and an arrow 15 are indicated to the right in FIG. 3C on the outside of the recessed section 12 of the housing 11. The word "UP" and the arrow 15 are provided to indicate that the housing 11 is to be mounted on the vertical or approximately vertical surface of the hull 52 with the arrow 15 pointing upward. Thus, the right side of the FIG. 3A faces downward when the housing 11 is preferably mounted on the vertical or approximately vertical surface of the hull 52. In addition, a water drain hole 16 is provided in the bottom side of the recessed section 12 when the housing 11 is mounted to the hull 52. The water drain hole 16 is provided to drain water by its own weight when water enters the recessed section 12 of the housing 11 after the housing 11 is mounted on the vertical or approximately vertical surface of the hull 52. Moreover, the water drain hole 16 is provided in a position that is spaced away from a position below an answer-back buzzer 21, which will be described later, or more specifically, on the opposite side of a vertical center line of the recessed section 12 from the answer-back buzzer 21. Therefore, even when water enters from the water drain hole 16, it is possible to avoid direct contact of water with the answer-back buzzer 21.

A cable 18 that connects a control unit, which will be described later, and the switch panel 57 is extended from the bottom side of the recessed section 12 when the housing 11 is mounted to the hull 52. The cable 18 is fixed to a cable support section 19 of the housing 11 by a clamp band 17. Because the immobilizer receiver 10 in this preferred embodiment preferably is not provided with its own power source, it is adapted to receive power from the hull 52 side and activate the control unit, which will be described later, and the answer-back buzzer 21 with the power. The cable 18 may directly be connected to the ECU in the outboard motor 1 depending on a case. In such a case, the ECU may perform the above control on the basis of a reception result from the immobilizer receiver 10.

The reference numeral 20 in FIGS. 3A-3E denotes the control unit that is housed in a liquid-tight case to authenticate the authentication code and to output an authentication result to the switch panel 57 via the answer-back buzzer 21 and the cable 18, and that is fixed to the bottom surface 14 of the recessed section 12 preferably by two screws 61, for example. The control unit 20 is connected to connecting wires in the cable 18 by a connector 22, which is called a tab or bullet terminal. The answer-back buzzer 21 is also connected to the connecting wires in the cable 18 via another connector (tab or bullet terminal) 23.

An antenna wire 24 that is connected to the control unit 20 is extended from the connector 22. The antenna wire 24 receives the authentication code from a transponder (not shown). The antenna wire 24 is arranged along the peripheral wall and the bottom surface 14 of the recessed section 12 of the housing 11, and an end of the antenna wire 24 is connected to the bottom surface of the control unit 20. Accordingly, the antenna wire 24 is fixed to the bottom surface 14 of the recessed section 12 by being pressed by the control unit 20.

The answer-back buzzer 21 is housed in the recessed section 12 in a state that the main body of the answer-back buzzer 21 is separated from all the surfaces of the recessed section 12, that is, in a so-called floating state. The answer-back buzzer 21 is also attached to a projection 25 that projects in the recessed section 12 of the housing 11 preferably via a screw 62 and a bracket 26, for example. It is preferable that the answer-back buzzer 21 contact as little water as possible because of its poor resistance to water. Thus, if the answer-back buzzer 21 is in the floating state, water flows down along the peripheral walls of the recessed section 12 even in a case that water enters the recessed section 12. Consequently, there is little possibility that the answer-back buzzer 21 gets wet, and thus, the answer-back buzzer 21 can function properly.

As described above, in the immobilizer receiver for an outboard motor in this preferred embodiment, the control unit 20 that is housed in the liquid-tight case and receives the authentication code, the antenna wire 24 arranged to receive the authentication code, and the answer-back buzzer 21 arranged to provide an indication of receipt of the authentication code are housed in the recessed section 12 of the housing 11. The distance between the opening surface 13 and the bottom surface 14 of the recessed section 12 of the housing 11 is set as the predetermined distance, and then the opening surface 13 of the housing 11 is preferably mounted on the vertical or approximately vertical surface of the hull. Accordingly, because the antenna wire 24, which is housed in the recessed section 12 so as to follow the bottom surface 14 thereof, is removed from the mounting surface of the hull for the predetermined distance, it is possible to secure the receiving function of the antenna wire 24. In addition, because the answer-back buzzer 21 with the poor water resistance can be covered with the housing 11, which is mounted to the hull, it is possible to secure the function of the answer-back buzzer 21. Consequently, the overall functions of the receiver can be secured while the attachment thereof can be facilitated.

In other words, because the antenna wire 24 is separated from the mounting surface of the hull for the predetermined distance, the immobilizer receiver can be mounted without consideration of the position of the antenna wire 24 even in a case that the immobilizer receiver is mounted to a metallic hull. Therefore, it is possible to facilitate the mounting of the immobilizer receiver.

In addition, because the antenna wire 24 is housed in the recessed section 12 while following the peripheral walls thereof, it is possible to secure the length of the antenna wire 24. Moreover, because the antenna wire 24 is unlikely to be removed from the bottom surface 14 of the recessed section 12, it is possible to secure the receiving function of the antenna wire 24.

The predetermined distance from the opening surface 13 to the bottom surface 14 of the recessed section 12 of the housing 11 is preferably set in a manner that the antenna wire 24 can receive the authentication code even when the hull to which the opening surface 13 of the housing 11 is mounted is made of metal. Therefore, it is possible to secure the receiving function of the antenna wire 24 and also to facilitate mounting of the antenna wire 24 to the hull.

In addition, the antenna wire 24 is fixed to the bottom surface 14 of the recessed section 12 of the housing 11 preferably by being pressed by the control unit 20. Therefore, it is possible to secure the distance between the antenna wire 24 and the mounting surface of the hull, and thus possible to secure the receiving function of the antenna wire 24.

The main body of the answer-back buzzer 21 is housed in the recessed section 12 of the housing 11 in the state that the answer-back buzzer 21 is separated from all the surfaces of the recessed section 12. Accordingly, even when water enters the recessed section 12 of the housing 11, water flows down the surfaces of the recessed section 12, and thus water does not contact the answer-back buzzer 21 with the poor water resistance. Therefore, it is possible to secure the function of the answer-back buzzer 21.

In addition, the upper direction upon mounting of the immobilizer receiver is indicated on the outside of the recessed section 12 of the housing 11. The water drain hole 16 is also formed in the portion of the recessed section 12 that faces down when being mounted to the hull. Accordingly, even when water enters the recessed section 12 of the housing 11, water is drained from the water drain hole 16. Therefore, it is possible to secure the functions of the components with the poor water resistance such as the answer-back buzzer 21.

Moreover, because the water drain hole 16 is located at a position in the recessed section 12 that is spaced away from the lower position of the answer-back buzzer 21, even when water enters from the water drain hole 16, it is possible to avoid direct contact of water with the answer-back buzzer 21.

An outboard motor to which the immobilizer receiver for an outboard motor according to the present invention is not limited to that described in the above preferred embodiments. Similarly, a watercraft to which the immobilizer receiver for an outboard motor according to the present invention is applied is not limited to the one described in the above preferred embodiments.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An immobilizer receiver for an outboard motor, the immobilizer receiver comprising:

a control unit housed in a liquid-tight case and arranged to receive an authentication code;

an antenna wire arranged to receive the authentication code;

an answer-back buzzer arranged to provide an indication that the authentication code has been received; and a housing made of an insulating material and arranged to house the control unit, the antenna wire, and the answer-back buzzer in a recessed section of the housing; wherein the recessed section of the housing includes an opening surface and a bottom surface opposite to the opening surface, the opening surface defining a mounting surface to be mounted to a surface of a hull, the opening surface and the bottom surface arranged to have a predetermined distance therebetween, and the recessed section houses therein the antenna wire disposed along the bottom surface of the recessed section.

2. The immobilizer receiver for an outboard motor according to claim 1, wherein the antenna wire is disposed along a peripheral wall of the recessed section.

3. The immobilizer receiver for an outboard motor according to claim 1, wherein the predetermined distance from the opening surface to the bottom surface of the recessed section of the housing is set such that the antenna wire can receive the authentication code even when the hull to which the opening surface of the housing is mounted is made of metal.

4. The immobilizer receiver for an outboard motor according to claim 1, wherein the antenna wire is fixed to the bottom surface of the recessed section of the housing and is arranged to be pressed by the control unit.

5. The immobilizer receiver for an outboard motor according to claim 1, wherein a main body of the answer-back buzzer is housed in the recessed section of the housing in a state that the main body is separated from all surfaces of the recessed section.

6. The immobilizer receiver for an outboard motor according to claim 1, wherein an upward direction upon mounting the immobilizer receiver to the hull is indicated on an outside of the recessed section of the housing, and a water drain hole is provided in a portion of the recessed section that faces downward when the immobilizer receiver is mounted to the hull.

7. The immobilizer receiver for an outboard motor according to claim 6, wherein the water drain hole is located in the recessed section that is spaced away from a position below the answer-back buzzer upon mounting the immobilizer receiver to the hull.

* * * * *